US011626691B2

(12) United States Patent
Lim et al.

(10) Patent No.: US 11,626,691 B2
(45) Date of Patent: Apr. 11, 2023

(54) CONNECTOR ASSEMBLY

(71) Applicant: Tyco Electronics AMP Korea Co., Ltd., Kyongsangbuk-Do (KR)

(72) Inventors: Keun Taek Lim, Gyeongsan-si (KR); Ki Ho Choi, Gyeongsan-si (KR)

(73) Assignee: Tyco Electronics AMP Korea Co., Ltd., Gyeongsangbuk-do (KR)

( * ) Notice: Subject to any disclaimer, the term of this patent is extended or adjusted under 35 U.S.C. 154(b) by 0 days.

(21) Appl. No.: 17/361,543

(22) Filed: Jun. 29, 2021

(65) Prior Publication Data

US 2021/0408725 A1 Dec. 30, 2021

(30) Foreign Application Priority Data

Jun. 29, 2020 (KR) ..... 10-2020-0079434
Apr. 19, 2021 (KR) ..... 10-2021-0050572

(51) Int. Cl.
*H01R 13/62* (2006.01)
*H01R 13/629* (2006.01)

(52) U.S. Cl.
CPC ..... *H01R 13/62933* (2013.01)

(58) Field of Classification Search
CPC ..... H01R 13/62933–62961
See application file for complete search history.

(56) References Cited

U.S. PATENT DOCUMENTS 6,213,795 B1 4/2001 Drescher et al.
7,137,835 B2 * 11/2006 Shiga ..... H01R 13/62938 439/157
7,255,581 B2 * 8/2007 Yamaoka ..... H01R 13/62955 439/157
8,292,650 B2 * 10/2012 Makino ..... H01R 13/62955 439/345
9,837,763 B2 12/2017 Shibata

FOREIGN PATENT DOCUMENTS

JP 8330023 A 12/1996

OTHER PUBLICATIONS

English translation of JP 833023, dated Dec. 13, 1996, 34 pages.

* cited by examiner

*Primary Examiner* — Ross N Gushi
(74) *Attorney, Agent, or Firm* — Barley Snyder

(57) ABSTRACT

A connector assembly comprises a first connector including a first connector body, and a shaft connected to the first connector body. A lever is rotatably connected to the shaft and is selectively fixable to the first connector body in a caught state. A second connector of the assembly includes a second connector body insertable into the first connector body, a releasing element defined on the second connector body for releasing the lever from the caught state, and a biasing element defined on the second connector body for rotating the lever after being released from the caught state.

14 Claims, 5 Drawing Sheets

CONNECTOR ASSEMBLY

CROSS-REFERENCE TO RELATED APPLICATIONS

This application claims priority under 35 U.S.C. § 119 to Korean Patent Application No. 10-2020-0079434 filed on Jun. 29, 2020, and Korean Patent Application No. 10-2021-0050572 filed on Apr. 19, 2021, the entire disclosures of which are incorporated herein by reference.

FIELD OF THE INVENTION

The present disclosure relates to electrical connectors, and more particularly, to a connector assembly including a mechanical-assist lever.

BACKGROUND

Connector assemblies and associated electrical cables are used to enable selective electrical connections between components of a system, such as between the numerous electrical components, power supplies, and accompanying sensors of an automobile. A connector assembly may include two connectors to be coupled together. In some applications, the connector assembly may include a mechanical assist lever rotatably attached to one of the two connectors for aiding in the mating and/or unmating of the two connectors. These levers, however, are often fragile in nature and thus subject to damage, particularly during transportation of the connector or connector assembly in a disassembled state.

Accordingly, there is a need for a lever-assisted connector or connector assembly which offers improved reliability over connectors of the prior art.

SUMMARY

A connector assembly according to an embodiment of the present disclosure comprises a first connector including a first connector body and a shaft connected to the first connector body. A lever is rotatably connected to the shaft and is selectively fixable to the first connector body in a caught state. A second connector of the assembly includes a second connector body insertable into the first connector body, a releasing element defined on the second connector body for releasing the lever from the caught state, and a biasing element defined on the second connector body for rotating the lever after being released from the caught state.

BRIEF DESCRIPTION OF THE DRAWINGS

The invention will now be described by way of example with reference to the accompanying Figures, of which.

DETAILED DESCRIPTION OF THE EMBODIMENTS

Figure 1:
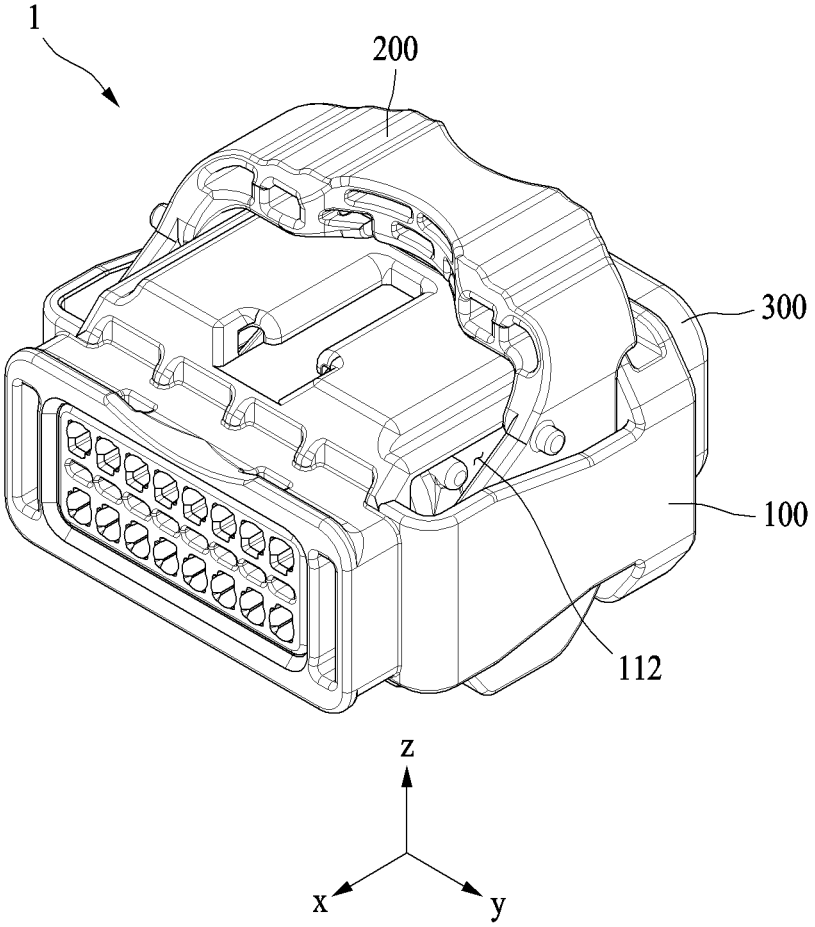
FIG. 1 is a perspective view illustrating a connector assembly according to an example embodiment.

Exemplary embodiments of the present disclosure will be described hereinafter in detail with reference to the attached drawings, wherein the like reference numerals refer to the like elements. The present disclosure may, however, be embodied in many different forms and should not be construed as being limited to the embodiment set forth herein; rather, these embodiments are provided so that the present disclosure will be thorough and complete, and will fully convey the concept of the disclosure to those skilled in the art.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Figure 2:
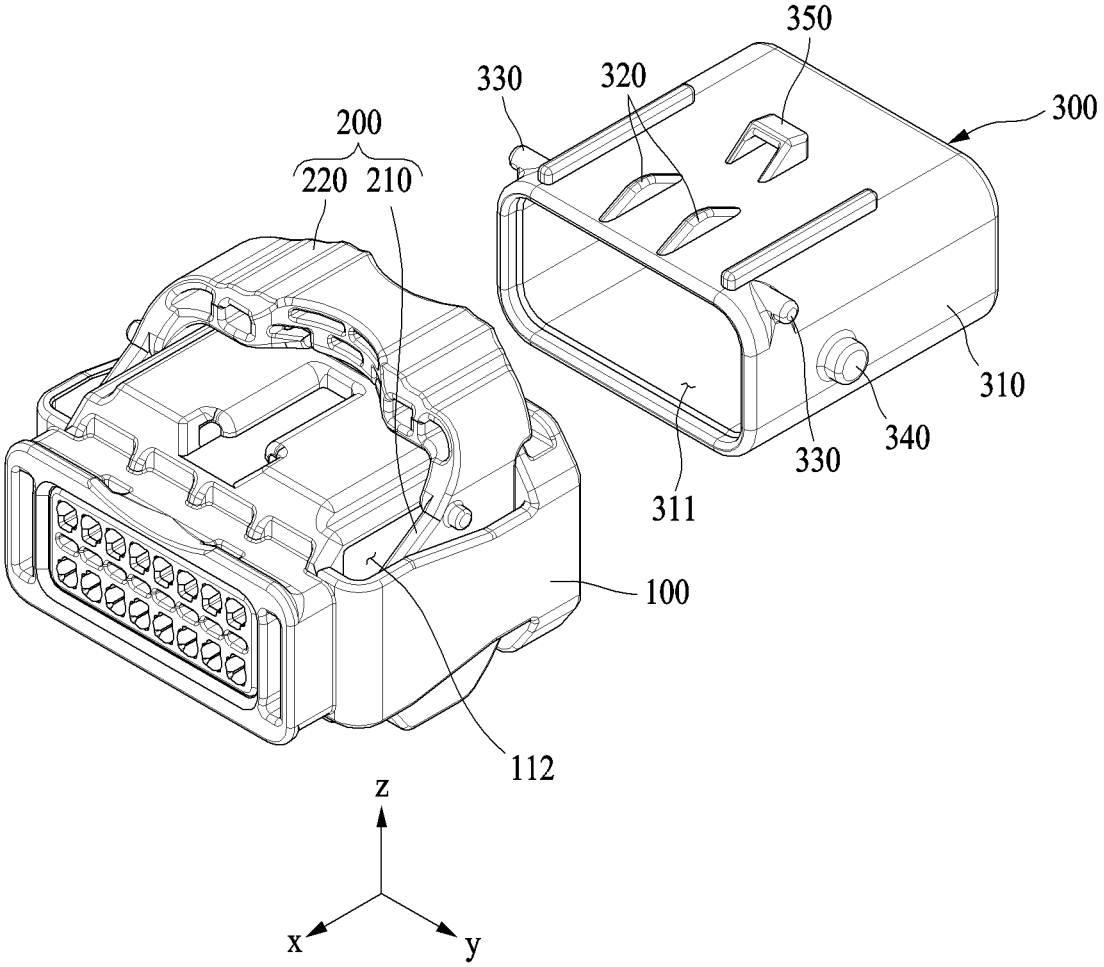
FIG. 2 is an exploded perspective view illustrating a first connector and a second connector of a connector assembly in a decoupled state according to an example embodiment.

Referring to FIGS. 1 and 2, a connector assembly 1 includes a first connector 100, a lever 200, and a second connector 300. The first connector 100 and the second connector 300 are fastened by moving the connectors toward each other in an x-axial or fastening direction. The lever 200 may assist in fully fastening the first connector 100 and the second connector 300. For example, the lever 200 may switch, or be biased into, to a fully opened state when the second connector 300 is inserted into the first connector 100 to a predetermined distance (see FIG. 6). Once inserted, a user may completely fasten the first connector 100 and the second connector 300 by applying pressure on the lever 200 while in the fully opened state. As referenced throughout, while the first connector 100 and the second connector 300 are spaced apart from each other in FIGS. 1 and 2, a state of the lever 200 being caught on or fixed to the first connector 100 will be referred to as a caught state. A state of the lever 200 being released from the caught state will be referred to as an opened or partially opened state (see FIG. 4), and a state of the lever 200 being maximally rotated will be referred to as a fully opened state (see FIG. 6). The first connector 100 may further include a lever receiving hole 112 for receiving the lever 200 and setting a range of rotation of the lever 200 between the above states.

The first connector 100 and the second connector 300 may be respectively connected to different electrical components, and the different electrical components may be physically and/or electrically connected by the connector assembly 1 (i.e., the first connector 100 and the second connector 300). The connector assembly 1 may be assembled when the second connector 300 moves toward the first connector 100 while the first connector 100 is fixed. Alternatively, the connector assembly 1 may be assembled when the first connector 100 moves toward the second connector 300 while the second connector 300 is fixed.

In the exemplary embodiment, the first connector 100 rotatably supports the lever 200, and includes a first receiving space for receiving the second connector 300 therein. The first connector 100 further defines the lever receiving hole(s) 112 through which a portion of the lever 200 passes. A pair of lever receiving holes 112 may be provided in each of the +y direction and the −y direction relative to a center of the first connector 100.

The lever 200 includes a pair of lever bodies 210 rotatably connected to the first connector 100 and passing through the lever receiving holes 112, and a lever cover 220 connecting the pair of lever bodies. The lever cover 220 may cover a top surface of the first connector 100, that is, a surface of the first connector 100 facing the +z direction.

In the illustrated embodiment, the second connector 300 is inserted into the first connector 100. More specifically, the second connector 300 may be moved in the x-axial or first direction, and be inserted into the first connector 100. The second connector 300 includes a releaser or releasing element provided to release the caught state of the lever 200, and a pressurizing or biasing element provided to pressurize and rotate the lever 200 in a state in which the caught state of the lever 200 is released. The releasing element and the biasing element may define protrusions formed in a body of the second connector 300. More specifically, the second connector 300 may include a second connector body 310 having a rib 320 protruding therefrom in a z-axial or second direction intersecting with the first direction. The second connector body 310 further defines a main protrusion 330 and an auxiliary protrusion 340 protruding from the second connector body in a y-axial or third direction intersecting with the first direction and the second direction, and a connector head 350 protruding from the second connector body at a position spaced apart from the rib 320. The second connector body 310 may have a second receiving space 311 therein. For example, the second connector body 310 may be formed in the shape of a hollow column. The rib 320 may protrude upward from the second connector body 310, that is, in the +z direction. While the second connector body 310 is inserted into the first connector body 110, the rib 320 may pressurize or bias the lever 200 upward in the +z direction to release the lever 200 from the caught state.

The main protrusion 330 may protrude from the second connector body 310. For example, the rib 320 may protrude in the z-axial or second direction, and the main protrusion 330 may protrude in the y-axial or third direction intersecting with the second direction. In other words, the main protrusion 330 may protrude laterally, that is, in the +y direction, from the second connector body 310. A pair of main protrusions 330 may be provided to correspond to the pair of lever bodies 210, respectively. For example, one of the pair of main protrusions 330 may protrude from the second connector body 310 in the +y direction, and the other one may be provided on the opposite side to the one main protrusion 330 and protrude from the second connector body 310 in the −y direction. Hereinafter, the main protrusion 330 will be described based on the main protrusion protruding in the +y direction.

The auxiliary protrusion 340 may protrude from the second connector body 310. For example, the auxiliary protrusion 340 may protrude in the y-axial direction, which is the third direction, as the main protrusion 330 does. In other words, the auxiliary protrusion 340 may protrude laterally in the +y direction, from the second connector body 310. The auxiliary protrusion 340 may be provided at a position spaced apart from the main protrusion 330 downward in the −z direction. For example, the auxiliary protrusion 340 may be provided at a position spaced apart from the main protrusion 330 rearward, that is, in the −x direction. Like the main protrusions 330, a pair of auxiliary protrusions 340 may be provided.

Each of the main protrusion 330 and the auxiliary protrusion 340 may interfere or engage with the lever 200. For example, the main protrusion 330 may switch or bias the lever 200 from the caught state to the fully opened state, and the auxiliary protrusion 340 may be pressurized by the lever 200 while the lever 200 is moving from the fully opened state back to the caught or initial state. The auxiliary protrusion 340 may be pressurized or biased in the +x direction by the lever 200, and the force applied to the auxiliary protrusion 340 may move the whole second connector 300 forward in the +x direction. The connector head 350 may fixedly engage with the lever 200 in a state in which the connector assembly 1 is completely assembled. For example, at least a portion of the lever 200 may be maintained in a state of being caught by the connector head 350.

Figure 3:
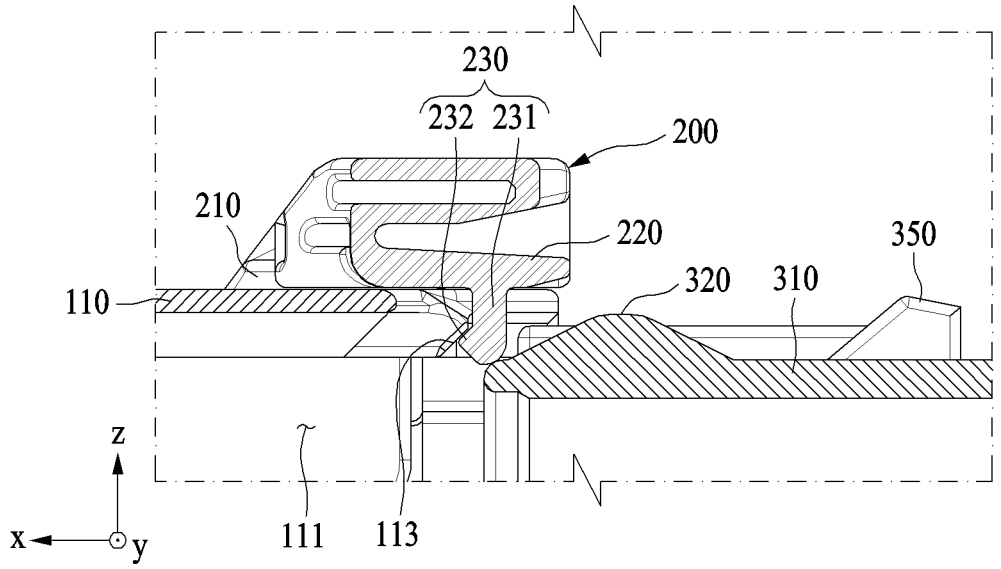
FIG. 3 is a cross-sectional view illustrating a connector assembly in which a lever is in a caught state according to an example embodiment.
Figure 4:
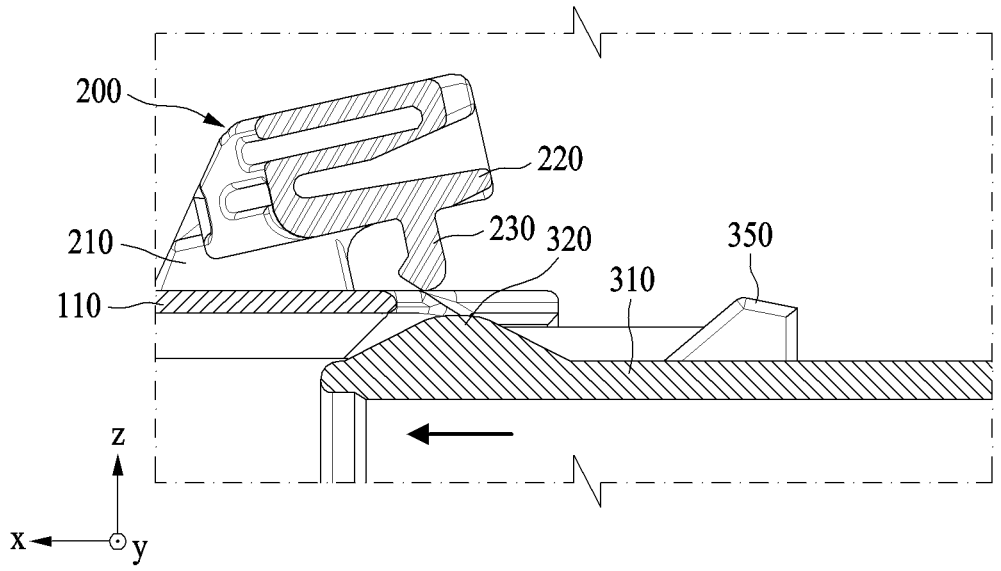
FIG. 4 is a cross-sectional view illustrating a connector assembly in which a lever is released from a caught state according to an example embodiment.

FIG. 3 is a cross-sectional view illustrating a connector assembly in which a lever is in the caught or initial state according to an example embodiment, and FIG. 4 is a cross-sectional view illustrating the connector assembly in which the lever is released from the caught state according to an example embodiment. In this way, FIGS. 3 and 4 illustrate the process of releasing the lever 200 from the caught state and into to the opened state.

Before the first connector body 110 and the second connector body 212 are coupled to each other, the lever 200 may be in a state of being caught on the first connector body 110. The first connector body 110 includes a receiving space 111 inside. As the lever 200 is caught on the first connector body 110, the lever 200 may be maintained in close contact with the first connector body 110 even when the first connector body 110 is shaken. This configuration may reduce or prevent the separation of the lever 200 from the first connector body 110 due to an impact applied to the lever 200 when the connector assembly 1 is transported in a disassembled state. This arrangement reduces the likelihood of damage to the first connector or to the lever during, for example, transportation in the disassembled state.

Still referring to FIG. 3, the lever 200 may include the lever bodies 210, the lever cover 220 connected to the lever bodies 210, and a lever arm 230 extending from the lever cover 220. The lever arm 230 may include an arm body 231 extending downward in the −z direction from the lever cover 220, and an arm head 232 protruding forward in the +x direction from the arm body 231. The arm head 232 may be caught on or latched to the first connector body 110 in a manner of being positioned at a lower side of the end portion of the first connector body 110. For example, the first connector body 110 may include a catch part 113 at the rear side at the end portion in the −x direction. The lever arm 230 may be caught by or latched to the catch part 113. The catch part 113 may have an inclined surface that is inclined upward toward the rear side of the catch part 113 and supports the arm head 232.

The rib 320 may pressurize or bias the lever arm 230 upward in the +z direction while the second connector body 310 is being inserted into the first connector body 110. In other words, while the second connector body 310 is being inserted in the first direction, the rib 320 protruding from the second connector body 310 in the second direction intersecting with the first direction may pressurize the lever arm 230 in the second direction. The rib 320 may include an inclined surface of which the height from the second connector body 310 decreases in the +x direction. The rib 320 may be in contact with the lever arm 230 through the inclined surface.

The lever arm 230 is caught by the connector head 350 in a state in which the connector assembly 1 is completely assembled. For example, at least a portion of the arm head 232 of the lever arm 230 may be inserted into the rear portion of the connector head 350. As the lever arm 230 is caught by the connector head 350, the movement of the second connector body 310 in the −x direction may be restricted unless a further external force is applied thereto.

Figure 5:
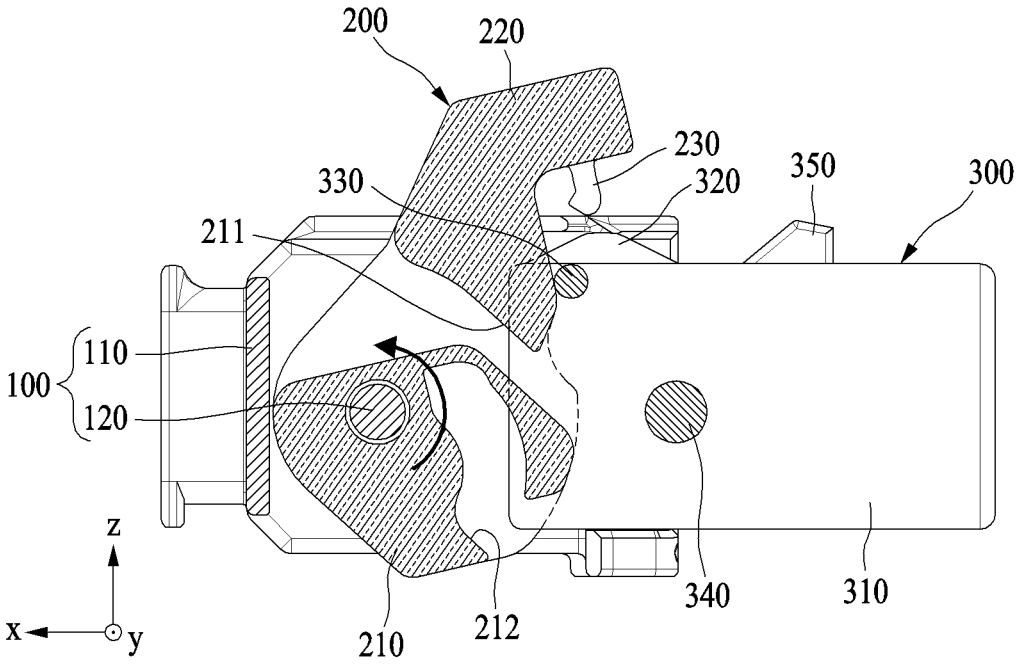
FIG. 5 is a cross-sectional view illustrating a connector assembly in which a main protrusion pressurizes and rotates a lever according to an example embodiment.
Figure 6:
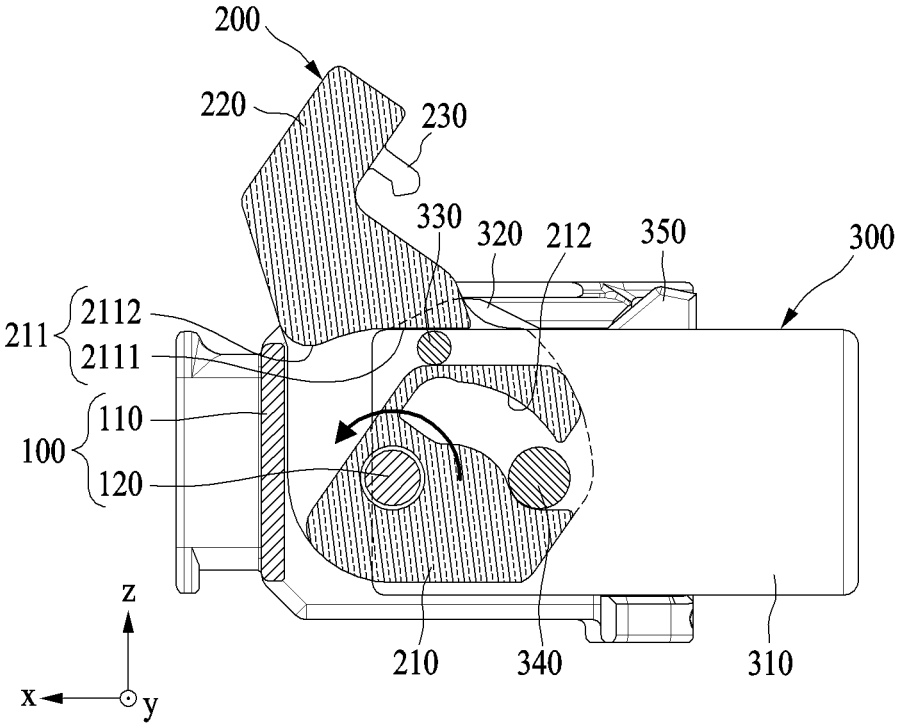
FIG. 6 is a cross-sectional view illustrating a connector assembly in which a main protrusion and an auxiliary protrusion are received in a main guide and an auxiliary guide, respectively, according to an example embodiment.
Figure 7:
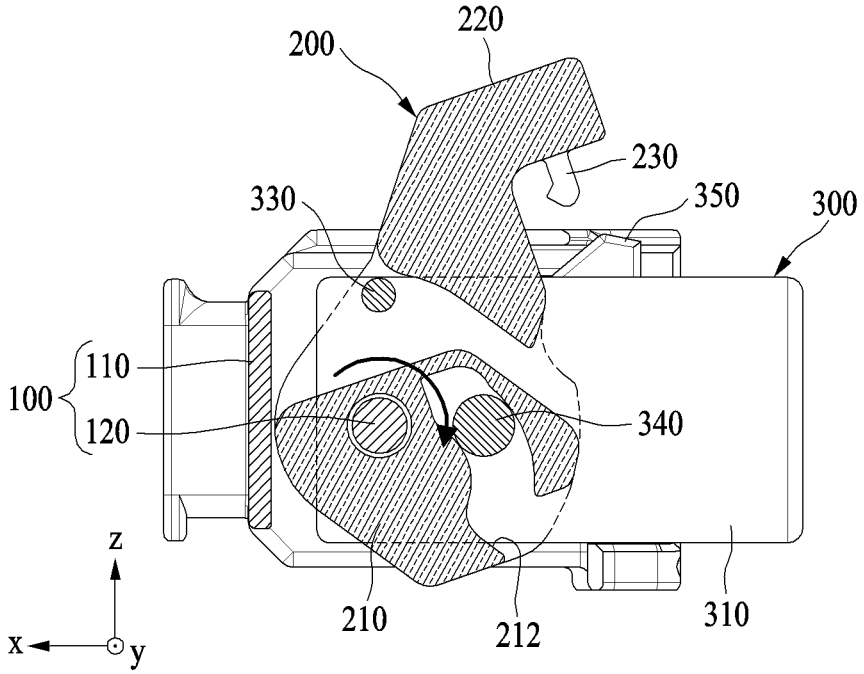
FIG. 7 is a cross-sectional view illustrating a connector assembly in which an auxiliary protrusion moves along an auxiliary guide as a lever rotates according to an example embodiment.
Figure 8:
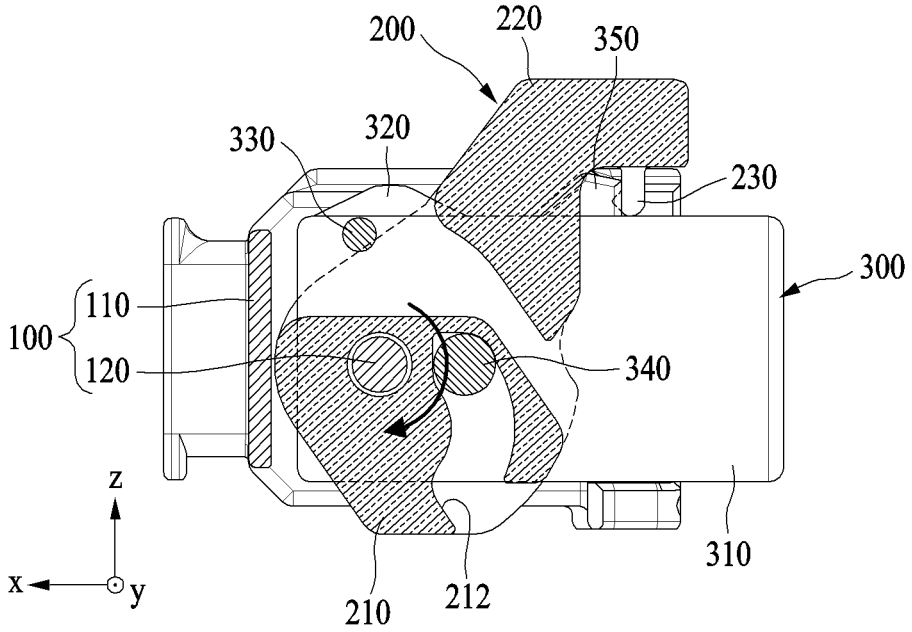
FIG. 8 is a cross-sectional view illustrating a connector assembly that is completely assembled according to an example embodiment.

FIG. 5 is a cross-sectional view illustrating a connector assembly in which a main protrusion pressurizes and rotates a lever according to an example embodiment, and FIG. 6 is a cross-sectional view illustrating the connector assembly in which the main protrusion and an auxiliary protrusion are received in a main guide and an auxiliary guide, respectively, according to an example embodiment. FIG. 7 is a cross-sectional view illustrating a connector assembly in which an auxiliary protrusion moves along an auxiliary guide as a lever rotates according to an example embodiment. FIG. 8 is a cross-sectional view illustrating the connector assembly that is completely assembled according to an example embodiment. FIGS. 5 and 6 illustrate the process of switching the lever 200 from a partially opened state to the fully opened state. FIGS. 6, 7, and 8 illustrate the process of switching the lever 200 from the fully opened state back to the caught state or the initial state.

Referring to FIGS. 5-8, the first connector 100 includes the first connector body 110 and a shaft 120 provided in the first connector body 110. The lever 200 includes the lever body 210 rotatably connected to the shaft 120, the lever cover 220 connected to the lever body 210, and the lever arm 230 extending from the lever cover 220. The second connector 300 includes the second connector body 310, the rib 320, the main protrusion 330, the auxiliary protrusion 340, and the connector head 350.

The main protrusion 330 protrudes in the third direction (y-axial direction) intersecting with each of the first direction (x-axial direction) and the second direction (z-axial direction), where the first direction is a direction in which the second connector body 310 is inserted, and the second direction is a direction in which the rib 320 protrudes. The main protrusion 330 interferes with the lever body 210 and pressurize the lever body 210. While the second connector body 310 is being inserted into the first connector body 110, the main protrusion 330 may pressurize the lever body 210. The lever body 210 may rotate about the shaft 120, and the main protrusion 330 and the lever body 210 may be in contact with each other at a position spaced apart from the shaft 120 upward, that is, in the +z direction. In this way, the lever body 210 is rotated counterclockwise by the main protrusion 330.

The lever body 210 includes a main guide 211 comprises an opening for receiving the main protrusion 330. The opening of the main guide 211 may not be aligned with the main protrusion 330 unless the lever 200 is in the fully opened state, and may be aligned with the main protrusion 330 only when the lever 200 is in the fully opened state. While the second connector body 310 is being inserted into the first connector body 110, the main protrusion 330 rotates the lever body 210, and enter the main guide 211 in a state in which the lever body 210 is rotated at a predetermined angle. When the main protrusion 330 enters the main guide 211, the main protrusion 330 passes through the lever body 210 along the main guide 211 without rotating the lever body 210 counterclockwise.

The exemplary main guide 211 includes a first guide 2111 having an opening, and a second guide 2112 extending from the first guide 2111. The second guide 2112 extends in the +x direction based on a state in which the main protrusion 330 enters the first guide 2111, and have a shape that expands toward the shaft 120. As a result of this shape, the main protrusion 330 may be prevented from interfering with the lever body 210 while the lever 200 rotates clockwise to couple the first connector 100 and the second connector 300.

The auxiliary protrusion 340 is interfered with by the lever body 210. Specifically, while the lever body 210 rotates, the auxiliary protrusion 340 is pressurized by the lever body 210. The lever body 210 may further include an auxiliary guide 212 comprising an opening for receiving the auxiliary protrusion 340. The opening of the auxiliary guide 212 may not be aligned with the auxiliary protrusion 340 unless the lever 200 is in the fully opened state, and may be aligned with the auxiliary protrusion 340 only when the lever 200 is in the fully opened state.

The auxiliary protrusion 340 protrudes in the third direction (y-axial direction) intersecting with each of the first direction (x-axial direction) and the second direction (z-axial direction), where the first direction is the direction in which the second connector body 310 is inserted, and the second direction is the direction in which the rib 320 protrudes. If a user rotates the lever 200 clockwise in a state in which the auxiliary protrusion 340 is received in the auxiliary guide 212, the auxiliary protrusion 340 may be pressurized by the lever body 210 for moving the second connector 300 forward in the +x direction.

The connector assembly 1 allows the lever 200 to be released from the initial or caught state through an operation of fastening the first connector 100 and the second connector 300 without separately operating the lever 200, thereby providing improved convenience. In addition, as the lever 200 is fixed in close contact with the first connector 100 until the connector assembly 1 is assembled, damage to the lever 200 by an external impact may be reduced. For example, if the lever 200 is released as shown in FIG. 6 or 7, the lever 200 may be damaged by an external impact. However, according to the present disclosure, the lever 200 is in close contact with the first connector 100 in a state in which the connector assembly 1 is not assembled, and the risk of damage is reduced.

It should be appreciated for those skilled in this art that the above embodiments are intended to be illustrated, and not restrictive. For example, many modifications may be made to the above embodiments by those skilled in this art, and various features described in different embodiments may be freely combined with each other without conflicting in configuration or principle.

Although several exemplary embodiments have been shown and described, it would be appreciated by those skilled in the art that various changes or modifications may be made in these embodiments without departing from the principles and spirit of the disclosure, the scope of which is defined in the claims and their equivalents.

As used herein, an element recited in the singular and proceeded with the word "a" or "an" should be understood as not excluding plural of said elements or steps, unless such exclusion is explicitly stated. Furthermore, references to "one embodiment" of the present disclosure are not intended to be interpreted as excluding the existence of additional embodiments that also incorporate the recited features.

Moreover, unless explicitly stated to the contrary, embodiments "comprising" or "having" an element or a plurality of elements having a particular property may include additional such elements not having that property.

What is claimed is:

1. A connector assembly, comprising:

a first connector including a first connector body, and a shaft connected to the first connector body;

a lever rotatably connected to the shaft and selectively fixable to the first connector body in a caught state, the lever has a main guide with a first guide having an opening and a second guide extending from the first guide and having a shape that expands toward the shaft; and a second connector including:

a second connector body insertable into the first connector body;

a releasing element defined on the second connector body for releasing the lever from the caught state; and a biasing element defined on the second connector body for rotating the lever after being released from the caught state, the biasing element has a main protrusion protruding from the second connector body and adapted to apply a force on the lever, the main protrusion is received in the opening of the first guide.

2. The connector assembly of claim 1, wherein the lever comprises:

a pair of lever bodies rotatably connected to the shaft;

a lever cover connecting the pair of lever bodies; and a lever arm extending from the lever cover and adapted to be caught on the first connector body.

3. The connector assembly of claim 2, wherein the releasing element comprises a rib protruding from the second connector body for applying a pressure on the lever arm to release the caught state of the lever.

4. The connector assembly of claim 3, wherein the rib acts on the lever arm in a second direction intersecting with a first direction while the second connector body is inserted into the first connector body in the first direction.

5. The connector assembly of claim 2, wherein the lever arm comprises:

an arm body extending from the lever cover; and an arm head protruding from the arm body and adapted to be caught on the first connector body.

6. The connector assembly of claim 1, wherein, with the second connector body inserted into the first connector body, the main protrusion rotates the lever and enters the main guide in a state in which the lever is rotated at a predetermined angle.

7. The connector assembly of claim 1, wherein the second connector further comprises an auxiliary protrusion protruding from the second connector body at a position spaced apart from the main protrusion.

8. The connector assembly of claim 7, wherein the lever comprises an auxiliary guide receiving the auxiliary protrusion.

9. The connector assembly of claim 1, wherein the second connector further comprises a connector head protruding from the second connector body at a position spaced apart from the releasing element, the lever being caught by the connector head in a state in which the second connector is inserted into the first connector.

10. A connector assembly, comprising:

a first connector including a first connector body defining a catch;

a lever rotatably connected to the first connector body between a first caught state, in which the lever engages with the catch for fixing the lever relative to the first connector body, and a fully opened state; and a second connector including a second connector body mateable with the first connector body, the second connector has a first protrusion for rotating the lever to a fully opened state after being released from the first caught state and a second protrusion at a position spaced apart from the first protrusion, the second protrusion engages with a second guide of the lever for biasing the second protrusion while the lever is moved from the fully opened state to a second caught state in which the lever is fixed to the second connector body.

11. The connector assembly of claim 10, wherein the lever comprises a first guide receiving the first protrusion.

12. The connector assembly of claim 10, further comprising a releasing element defined on the second connector body for releasing the lever from the first caught state as the first connector is mated with the second connector.

13. The connector assembly of claim 10, wherein the second connector further comprises a connector head protruding from the second connector body, the lever engaging with the connector head in the second caught state.

14. The connector assembly of claim 10, wherein the lever comprises:

a pair of lever bodies rotatably connected to the first connector body;

a lever cover connecting the pair of lever bodies; and a lever arm extending from the lever cover and adapted to be caught on the first connector body.

* * * * *